US011673176B2

(12) United States Patent
Xie et al.

(10) Patent No.: US 11,673,176 B2
(45) Date of Patent: Jun. 13, 2023

(54) SERVO-DRIVEN Z-SHAPE BENDING DEVICE FOR TERMINAL

(71) Applicants: Tyco Electronics (Shanghai) Co. Ltd., Shanghai (CN); Tyco Electronics Polska Sp. z.o.o., Warsaw (PL); TE Connectivity Services GmbH, Schaffhausen (CH); Kunshan League Automechanism Co., Ltd., Kunshan (CN)

(72) Inventors: Fengchun Xie, Shanghai (CN); Jaroslaw Kowalski, Bydgoszcz (PL); Andrzej Przybylski, Bydgoszcz (PL); Dandan Zhang, Shanghai (CN); Lvhai Hu, Shanghai (CN); Yingcong Deng, Shanghai (CN); Jian Cao, Shanghai (CN); Radoslaw Mrozik, Bydgoszcz (PL); Roberto Francisco-Yi Lu, Bellevue, WA (US); Haidong Wu, Kunshan (CN)

(73) Assignees: TE Connectivity Solutions GmbH, Schaffhausen (CH); Tyco Electronics (Shanghai) Co., Ltd., Shanghai (CN); Kunshan Leagure Automechanism Co., Ltd., Kunshan (CN); Tyco Electronics Polska Sp. z.o.o, Warsaw (PL)

( * ) Notice: Subject to any disclaimer, the term of this patent is extended or adjusted under 35 U.S.C. 154(b) by 274 days.

(21) Appl. No.: 16/952,700

(22) Filed: Nov. 19, 2020

(65) Prior Publication Data

US 2021/0154720 A1 May 27, 2021

(30) Foreign Application Priority Data

Nov. 21, 2019 (CN) ..... 201922061453.6

(51) Int. Cl.
*H01R 43/16* (2006.01)
*B21D 5/02* (2006.01)

(52) U.S. Cl.
CPC ..... *B21D 5/02* (2013.01); *H01R 43/16* (2013.01)

(58) Field of Classification Search
CPC . B21D 7/022; B21D 7/02; B21D 7/06; B21D 11/06; B21D 11/07; B21D 5/02;
(Continued)

(56) References Cited

U.S. PATENT DOCUMENTS

2003/0154759 A1* 8/2003 Kobayashi ..... B21D 19/086 72/306
2020/0139417 A1* 5/2020 Low ..... B21D 43/003

FOREIGN PATENT DOCUMENTS

CN 210430389 U * 4/2020
JP 2006093408 A * 4/2006
KR 100242819 B1 * 11/1999

* cited by examiner

*Primary Examiner* — Shelley M Self
*Assistant Examiner* — Jared O Brown
(74) *Attorney, Agent, or Firm* — Barley Snyder

(57) ABSTRACT

A servo-driven Z-shape bending device includes a base, a Z-shape bending module disposed on the base, a servo-drive mechanism disposed on the base, and a terminal feeding mechanism disposed on the base. The Z-shape bending module is configured to perform a bending operation on a terminal to be bent to form a Z-shaped terminal. The servo-drive mechanism is configured to servo-drive the Z-shape bending module to perform the bending operation. The terminal feeding mechanism is configured to feed the terminal to be bent to the Z-shape bending module.

16 Claims, 5 Drawing Sheets

(58) Field of Classification Search
CPC . B21D 5/04; B21D 11/10; B21F 1/004; B21F 1/00
USPC ..... 72/380, 384, 386
See application file for complete search history.

SERVO-DRIVEN Z-SHAPE BENDING DEVICE FOR TERMINAL

CROSS-REFERENCE TO RELATED APPLICATION

This application claims the benefit of the filing date under 35 U.S.C. § 119(a)-(d) of Chinese Patent Application No. 201922061453.6, filed on Nov. 21, 2019.

FIELD OF THE INVENTION

The present disclosure relates to the field of manufacturing a part of an electric connector and, more particularly, to a servo-driven Z-shape bending device for a terminal.

BACKGROUND

In electric connectors, pin terminals serve as a bridge to achieve electric connections. With the rapid development of consumer electronics, automotive electronics, communication terminal markets, etc., it is necessary to adopt various shapes of pin terminals to meet connection requirements in different scenarios. For example, common shapes of the pin terminal include a straight line shape, an L shape, a U shape, and a Z shape.

In actual machining, Z-shaped pin terminals are usually formed by bending straight line-shaped pin terminals many times. Ideally, after the straight line-shaped pin terminals are bent, the Z-shaped pin terminals formed by bending need to have not only a uniform degree of bending, but also a high bending accuracy, so as to ensure the bending quality while guaranteeing the manufacturing efficiency.

SUMMARY

A servo-driven Z-shape bending device includes a base, a Z-shape bending module disposed on the base, a servo-drive mechanism disposed on the base, and a terminal feeding mechanism disposed on the base. The Z-shape bending module is configured to perform a bending operation on a terminal to be bent to form a Z-shaped terminal. The servo-drive mechanism is configured to servo-drive the Z-shape bending module to perform the bending operation. The terminal feeding mechanism is configured to feed the terminal to be bent to the Z-shape bending module.

BRIEF DESCRIPTION OF THE DRAWINGS

The invention will now be described by way of example with reference to the accompanying Figures, of which.

DETAILED DESCRIPTION OF THE EMBODIMENTS

Figure 1:
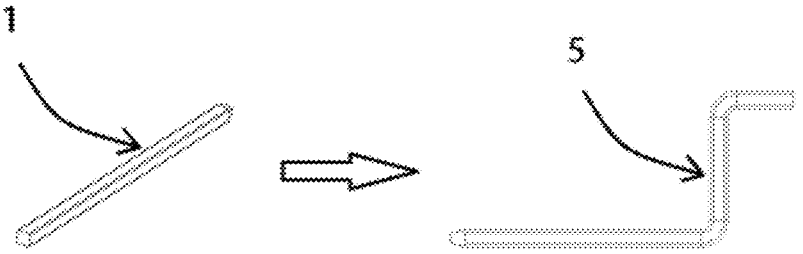
FIG. 1 is a schematic diagram of a straight line-shaped pin terminal formed into a Z-shaped pin terminal after a bending operation.

Technical solutions of the present disclosure will be further specifically described below by way of embodiments in conjunction with the drawings. The same or similar elements are indicated by the same or similar reference numerals in the description. The following description of embodiments of the present disclosure with reference to the drawings is intended to explain general inventive concept of the present disclosure and should not be construed as limiting the present disclosure.

In addition, in the following detailed description, for purposes of explanation, numerous specific details are set forth in order to provide a thorough understanding of the embodiments of the present disclosure. It will be apparent, however, that one or more embodiments may be implemented without these specific details. In other instances, well-known structures and devices are schematically shown in order to simplify the drawing.

A servo-driven Z-shape bending device for a terminal according to an embodiment performs a bending operation on a straight line-shaped pin terminal to obtain a Z-shaped pin terminal. FIG. 1 shows that a straight line-shaped pin terminal 1 is formed into a Z-shaped pin terminal 5 after a bending operation is performed on the straight line-shaped pin terminal 1 by the servo-driven Z-shape bending device. In addition, for the sake of brevity, "pin terminal" may also abbreviated to "terminal" throughout the description.

Figure 2:
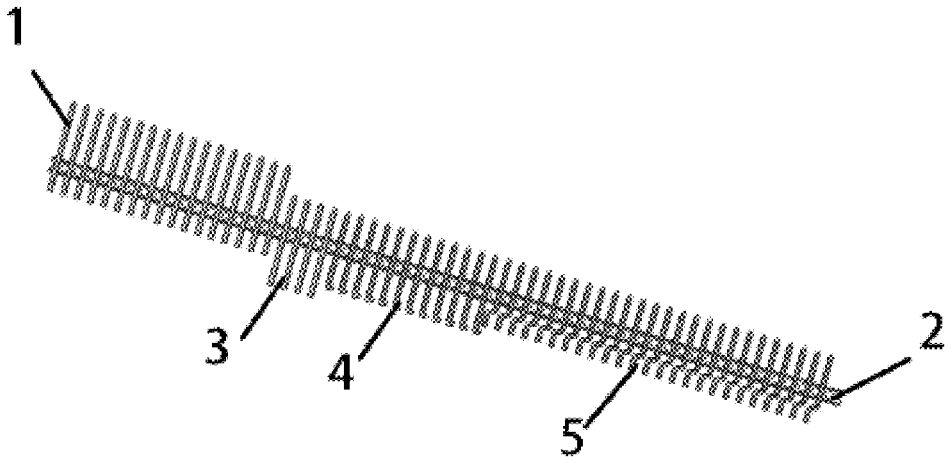
FIG. 2 is a perspective view of a carrier with a plurality of terminal pins in different states.

FIG. 2 shows a sequence of automatic bending of pin terminals in a carrier 2 while performing the bending operation with the servo-driven Z-shape bending device. As shown in FIG. 2, a plurality of pin terminals are arranged side by side in the carrier 2. From left to right, different pin terminals are in different states during the bending operation, respectively. For convenience of description, herein the terminal pins in the different states are denoted by different reference numbers to be distinguished from each other. Specifically, from left to right, the terminals shown in FIG. 2 are respectively terminals 1 to be bent which have not been proceeded by the bending device of the present disclosure, loosened terminals 3 to be bent which have been loosened out in the carrier 2, L-shaped terminals 4 formed after being proceeded by a first bending operation, and Z-shaped terminals 5 formed after being proceeded by a second bending operation (i.e. finally obtained).

Figure 3:
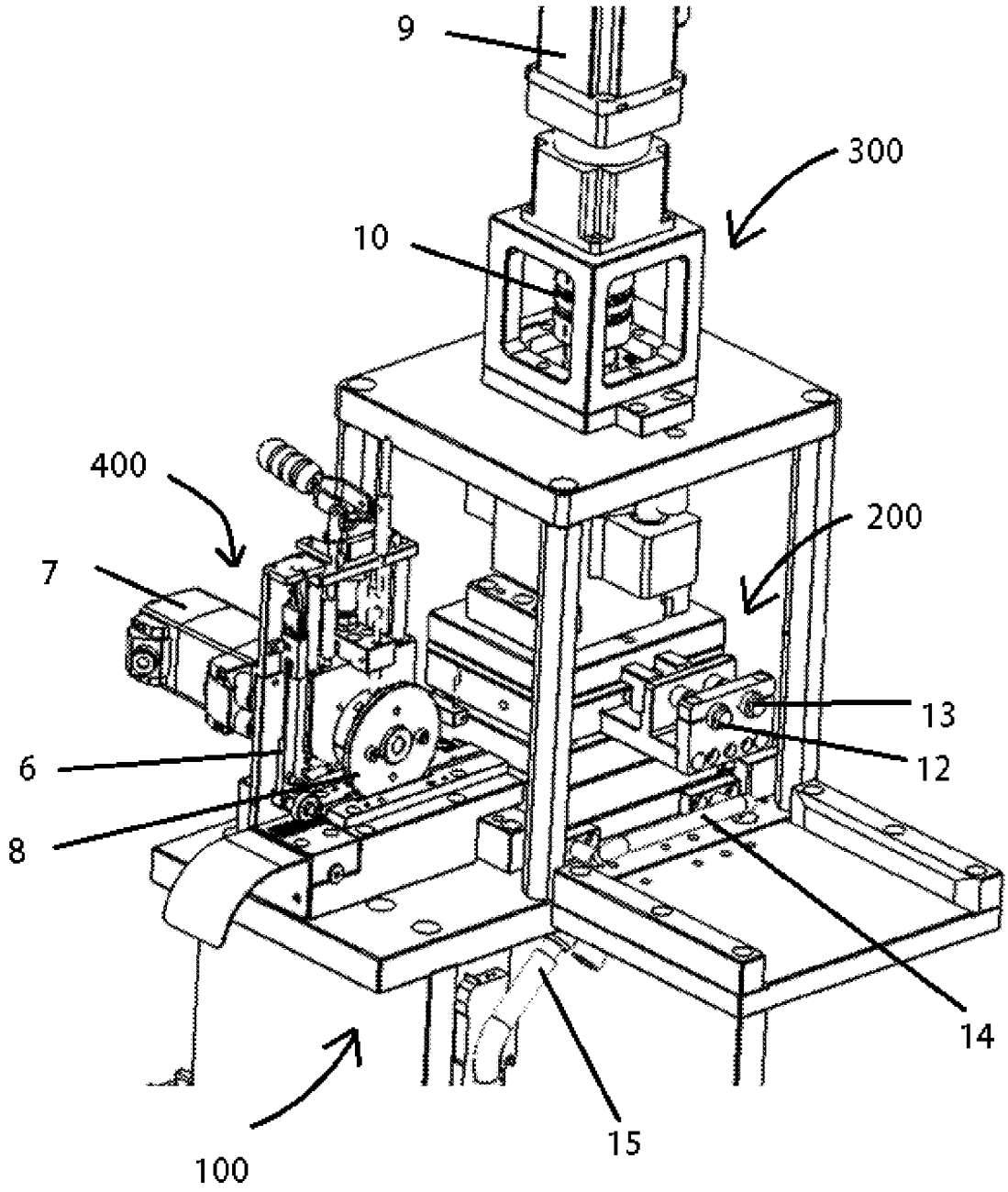
FIG. 3 is a perspective view of a servo-driven Z-shape bending device according to an embodiment.
Figure 4:
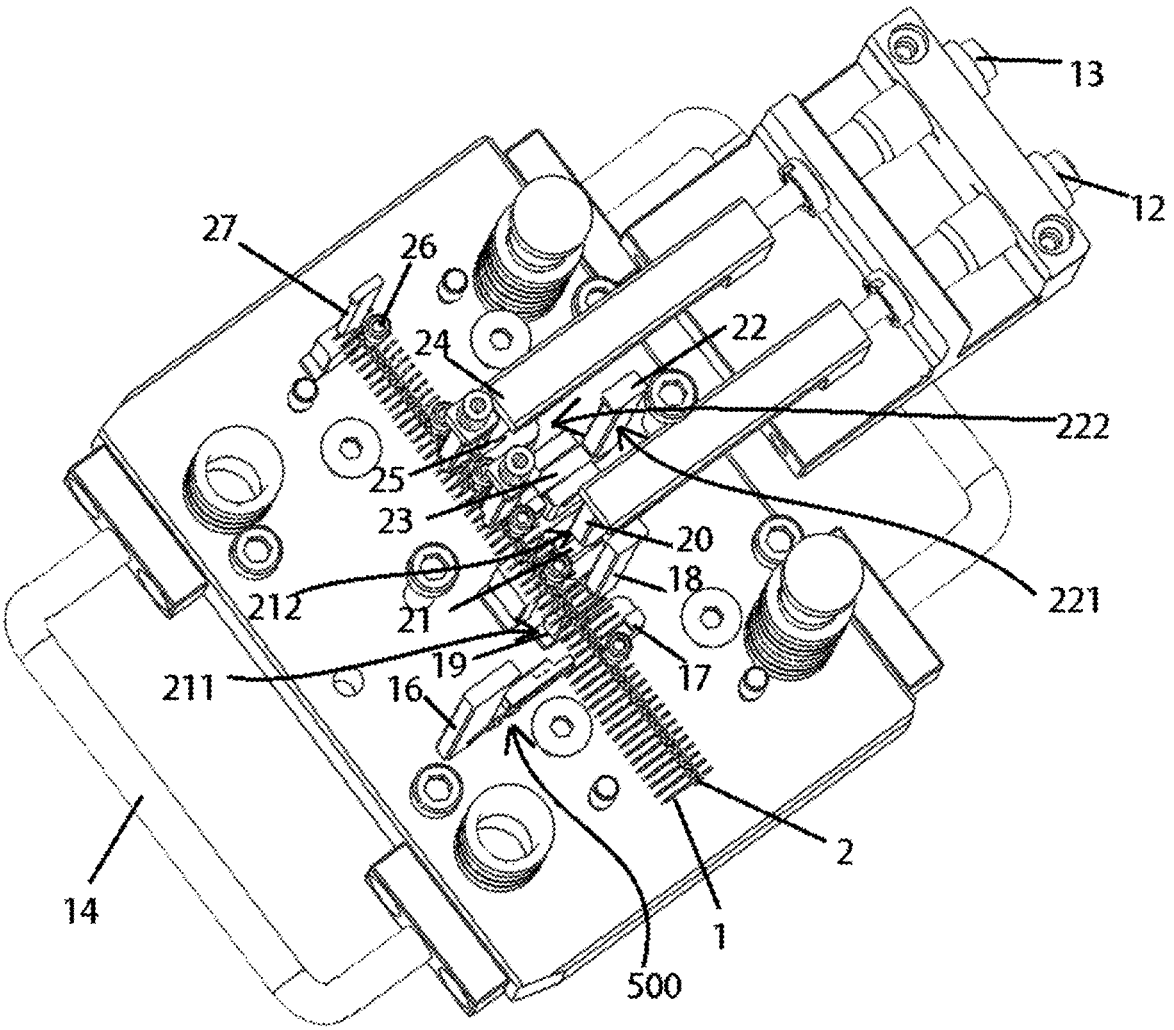
FIG. 4 is a perspective view of a Z-shape bending module of the servo-drive Z-shape bending device.

The servo-driven Z-shape bending device according to an embodiment, as shown in FIGS. 3 and 4, includes a base 100, and a terminal feeding mechanism 400, a terminal loosening mechanism 500, a Z-shape bending module 200, and a servo-drive mechanism 300 disposed on the base 100. The terminal feeding mechanism 400 is configured to feed the terminal (such as the straight line-shaped terminal 1 shown in FIG. 2) to be bent in the carrier (such as the carrier 2 shown in FIG. 2) to the Z-shape bending module. The terminal loosening mechanism 500 is configured to loosen the terminal (such as the loosened straight line-shaped terminal 3 shown in FIG. 2) be bent in the carrier 2 to facilitate performing the bending operation on the terminal to be bent subsequently. The Z-shape bending module 200 is configured to perform the bending operation on the terminal to be bent to form the Z-shaped terminal 5. The servo-drive mechanism 300 is configured to servo-drive the Z-shape bending module 200 to perform the bending operation.

As shown in FIGS. 3 and 4, in the illustrated exemplary embodiment, the terminal feeding mechanism 400 includes a feeding electric motor 7, a feeding ratchet 8, and a feeding sensor 6, which are mounted to the base 100. The feeding ratchet 8 is configured to feed the terminal to be bent by being driven by the feeding electric motor 7, and the feeding sensor 6 is configured to sense whether or not the terminal to be bent is located on a bending operation station. More specifically, as shown in FIGS. 2, 3, and 4, the terminal to be bent is carried by the carrier 2 and the feeding ratchet 8 is driven by the feeding electric motor 7 to feed the carrier 2 carrying the terminal to be bent to the Z-shape bending module 200 in a direction from left to right as shown in FIGS. 2-4. Meanwhile, the feeding sensor 6 senses whether or not the terminal to be bent has been fed onto a bending operation station in the Z-shape bending module 200, so that the Z-shape bending module 200 performs the bending operation.

As shown in FIGS. 3 and 4, in the illustrated exemplary embodiment, the terminal loosening mechanism 500 is disposed before the Z-shape bending module 200 in a traveling direction of the carrier 2 carrying the terminal to be bent. The terminal loosening mechanism 500 includes a loosening jig 16 and a loosening block 17. The loosening jig 16 is configured to push the terminal to be bent from the carrier 2 to the loosening block 17 such that a to-be-bent portion of the terminal to be bent is exposed from the carrier 2, and the Z-shape bending module 200 performs the bending operation on the portion.

In the servo-driven Z-shape bending device, the Z-shape bending module 200 includes a first terminal bending mechanism and a second terminal bending mechanism. The first terminal bending mechanism is configured to perform a first bending operation on the terminal to be bent to deform the terminal to be bent into an L-shaped terminal 4, and the second terminal bending mechanism is configured to perform a second bending operation on the L-shaped terminal 4 to deform the L-shaped terminal 4 into the Z-shaped terminal 5.

As shown in FIG. 4, the first terminal bending mechanism includes an L-shape bending sub-mechanism 211 and an L-shape shaping sub-mechanism 212. The L-shape bending sub-mechanism 211 is configured to bend the terminal to be bent. The L-shape shaping sub-mechanism 212 is configured to fine tune a degree of bending of the bent terminal and shape the bent terminal into the L-shaped terminal 4. The second terminal bending mechanism includes a Z-shape bending sub-mechanism 221 and a Z-shape shaping sub-mechanism 222. The Z-shape bending sub-mechanism 221 is configured to bend the L-shaped terminal 4. The Z-shape shaping sub-mechanism 222 is configured to fine tune a degree of bending of the bent L-shaped terminal 4 and shape the bent L-shaped terminal 4 into the Z-shaped terminal 5.

Figure 5:
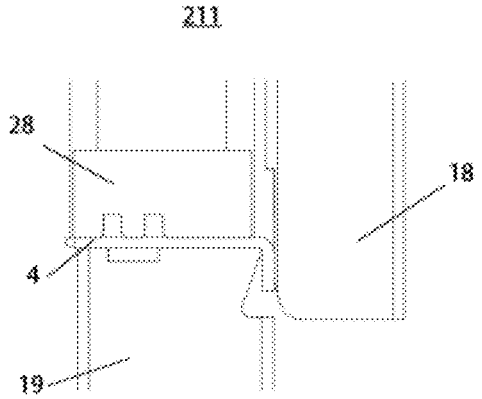
FIG. 5 is a sectional side view of an L-shape bending sub-mechanism of the Z-shape bending module.
Figure 6:
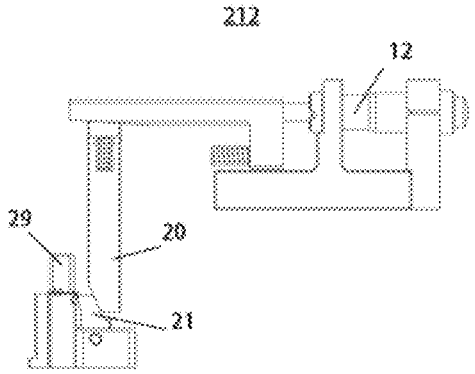
FIG. 6 is a sectional side view of an L-shape shaping sub-mechanism of the Z-shape bending module.
Figure 6A:
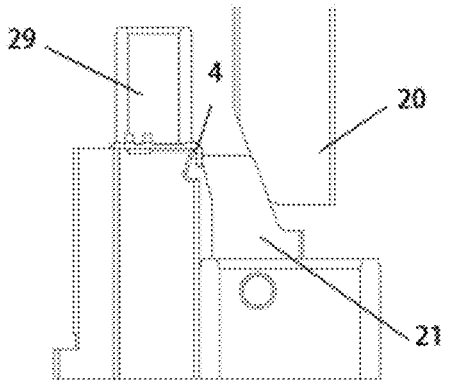
FIG. 6A is an enlarged view of a portion of FIG. 6.

As shown in FIGS. 5, 6 and 6A, in the illustrated exemplary embodiment, the L-shape bending sub-mechanism 211 includes an L-shape bending lower punch 19, an L-shape bending upper punch 18, and a first terminal pressing block 28, which are mounted to the base 100. The L-shape bending lower punch 19 is fixedly disposed, the L-shape bending upper punch 18 is configured to be movable relative to the L-shape bending lower punch 19 in a punching direction, and the first terminal pressing block 28 is adapted to press and fix the terminal to be bent on the L-shape bending lower punch 19. In operation, when the terminal to be bent is fed to the L-shape bending sub-mechanism 211, the terminal to be bent is located on the L-shape bending lower punch 19, the first terminal pressing block 28 presses and fixes the terminal to be bent on the L-shape bending lower punch 19, and the L-shape bending upper punch 18 is moved towards the L-shape bending lower punch 19 in the punching direction to perform a punching action on the terminal to be bent, so that the terminal to be bent is formed into a generally L-shaped, bent terminal 4.

As shown in FIGS. 5 and 6, in the illustrated exemplary embodiment, the L-shape shaping sub-mechanism 212 includes an L-shape shaping upper punch 20, an L-shape shaping lower punch 21, a second terminal pressing block 29, and an L-shape shaping micrometer 12, which are mounted to the base 100. The L-shape shaping lower punch 21 is adapted to be pressed against the bent terminal, and the L-shape shaping upper punch 20 and the L-shape shaping lower punch 21 abut against and fit with each other (for example, inclined planes of them are in contact with, abut against and fit with each other as shown in FIG. 6). The L-shape shaping micrometer 12 is configured to act on the L-shape shaping upper punch 20, to adjust movements of both the L-shape shaping upper punch 20 and the L-shape shaping lower punch 21 in a direction perpendicular to the punching direction, thereby adjusting the degree of bending of the bent terminal to shape the bent terminal into the L-shaped terminal accurately.

In operation, when the generally L-shaped, bent terminal 4 formed after being bent by the L-shape bending sub-mechanism 211 is fed to the L-shape shaping sub-mechanism 212, the second terminal pressing block 29 presses and fixes the bent terminal, and the L-shape shaping lower punch 21 is pressed against the bent portion of the bent terminal. In this case, the L-shape shaping micrometer 12 may be manipulated to adjust movements of both the L-shape shaping upper punch 20 and the L-shape shaping lower punch 21 in the direction perpendicular to the punching direction, thereby adjusting the degree of bending of the bent terminal to shape the bent terminal into the L-shaped terminal 4 accurately.

Figure 7:
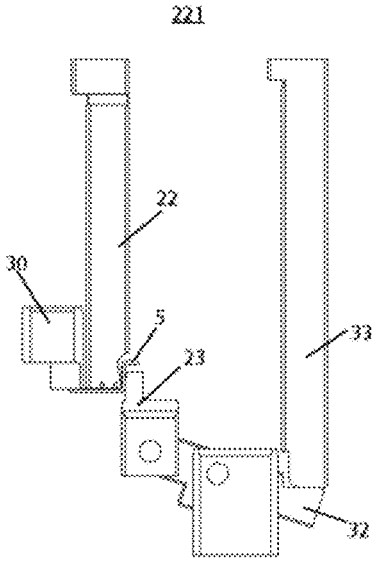
FIG. 7 is a sectional side view of an Z-shape bending sub-mechanism of the Z-shape bending module.
Figure 8:
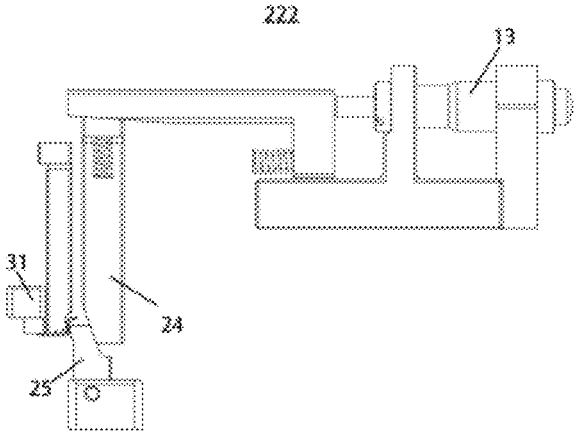
FIG. 8 is a sectional side view of an Z-shape shaping sub-mechanism of the Z-shape bending module.
Figure 8A:
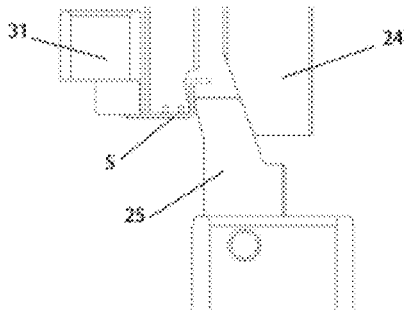
FIG. 8A is an enlarged view of a portion of FIG. 8.

As shown in FIGS. 7, 8 and 8A, in the illustrated exemplary embodiment, the Z-shape bending sub-mechanism 221 includes a Z-shape bending upper punch 22, a Z-shape bending lower punch 23, and a third terminal pressing block 30, which are mounted to the base 100. The Z-shape bending upper punch 22 is fixedly disposed, the Z-shape bending lower punch 23 is configured to be movable relative to the Z-shape bending upper punch 22 in the punching direction, and the third terminal pressing block 30 is adapted to press and fix the L-shaped terminal on the Z-shape bending upper punch 22.

As shown in FIGS. 7 and 8, in the illustrated exemplary embodiment, the Z-shape bending sub-mechanism 221 includes a lower punch controlling lever 33 mounted to the base 100, and a lower punch lifting lever 32. The lower punch controlling lever 33 is configured to control a movement of the Z-shape bending lower punch 23. The lower punch lifting lever 32 couples the Z-shape bending lower punch 23 to the lower punch controlling lever 33 and is configured to lift the Z-shape bending lower punch 23 under the control of the lower punch controlling lever 33, such that the Z-shape bending lower punch 23 is movable relative to the Z-shape bending upper punch 22 in the punching direction.

In operation, when the L-shaped terminal 4 is fed to the Z-shape bending sub-mechanism 221, the L-shaped terminal 4 is located below the Z-shape bending upper punch 22, and the third terminal pressing block 30 presses and fixes the L-shaped terminal 4 below the Z-shape bending upper punch 22. The Z-shape bending lower punch 23 is moved towards the Z-shape bending upper punch 22 in the punching direction to perform a punching action on the L-shaped terminal 4, so that the L-shaped terminal 4 is formed into a generally Z-shaped, bent terminal 5. More specifically, the Z-shape bending lower punch 23 is lifted under the control of the lower punch controlling lever 33, such that the Z-shape bending lower punch 23 is moved upwards relative to the Z-shape bending upper punch 22 in the punching direction to perform a punching action on the L-shaped terminal 4, so that the L-shaped terminal 4 is formed into a generally Z-shaped, bent terminal 5.

As shown in FIGS. 7, 8 and 8A, in the illustrated exemplary embodiment, the Z-shape shaping sub-mechanism 222 includes a Z-shape shaping upper punch 24, a Z-shape shaping lower punch 25, a fourth terminal pressing block 31, and a Z-shape shaping micrometer 13, which are mounted to the base 100. The Z-shape shaping lower punch 25 is adapted to be pressed against the generally Z-shaped, bent terminal 5, and the Z-shape shaping upper punch 24 and the Z-shape shaping lower punch 25 abut against and fit with each other (for example, inclined planes of them are in contact with, abut against and fit with each other as shown in FIG. 8). The Z-shape shaping micrometer 13 is configured to act on the Z-shape shaping upper punch 24, to adjust movements of both the Z-shape shaping upper punch 24 and the Z-shape shaping lower punch 25 in a direction perpendicular to the punching direction, thereby adjusting the degree of bending of the bent terminal to shape the bent terminal into the Z-shaped terminal 5 accurately.

In operation, when the generally Z-shaped, bent terminal 5 formed after being bent by the Z-shape bending sub-mechanism 221 is fed to the Z-shape shaping sub-mechanism 222, the fourth terminal pressing block 31 presses and fixes the bent terminal, and the Z-shape shaping lower punch 25 is pressed against the bent portion of the bent terminal. In this case, the Z-shape shaping micrometer 13 may be manipulated to adjust movements of both the Z-shape shaping upper punch 24 and the Z-shape shaping lower punch 25 in the direction perpendicular to the punching direction, thereby adjusting the degree of bending of the bent terminal to shape the bent terminal into the Z-shaped terminal 5 accurately.

In an embodiment, as shown in FIG. 3, the Z-shape bending module 200 includes a module handle 14.

In the servo-driven Z-shape bending device provided by the present disclosure, the servo-drive mechanism 300 is mainly configured to servo-drive the Z-shape bending module 200 to perform the bending operation. As shown in FIG. 3, in the illustrated exemplary embodiment, the servo-drive mechanism 300 includes a bending servo driver 9 and a servo coupling 10, which are mounted to the base 100. The bending servo driver 9 is coupled to the first terminal bending mechanism and the second terminal bending mechanism through the servo coupling 10, and the bending servo driver 9 is configured to provide the first terminal bending mechanism and the second terminal bending mechanism with a driving force through the servo coupling 10.

As shown in FIG. 4, in the illustrated exemplary embodiment, the servo-driven Z-shape bending device includes a carrier guiding device 26 disposed on the base 100 and configured to guide traveling of the carrier 2 carrying the terminal to be bent. The servo-driven Z-shape bending device may further include a carrier cutting blade 27 disposed on the base 100 and configured to cut out a portion of the carrier 2 carrying the Z-shaped terminal 5 after the Z-shaped terminal 5 is formed. As shown in FIGS. 3 and 4, in the illustrated exemplary embodiment, the terminal loosening mechanism 500, the first terminal bending mechanism, the second terminal bending mechanism, and the carrier cutting blade 27 are sequentially disposed on the base in the traveling direction of the carrier 2.

As shown in FIG. 3, in the illustrated exemplary embodiment, the servo-driven Z-shape bending device may further include a vacuum adsorber 15 disposed on the base 100 and configured to clean the portion of the carrier 2 carrying the Z-shaped terminal 5.

As can be seen, with the servo-driven Z-shape bending device provided by the present disclosure, the first and second bending operations are performed on the terminal to be bent by the first and second terminal bending mechanisms of the Z-shape bending module 200, respectively, and in each of the first and second bending operations, not only the bending sub-mechanism 211, 221 is used to perform the bending operation on the terminal, but also the shaping sub-mechanism 212, 222 is used to fine tune the degree of bending of the bent terminal. In this way, not only the degree of bending can be easily controlled and the bending quality can be ensured, but also the terminal bending efficiency can be improved. In addition, the servo-driven Z-shape bending device for the terminal (especially the Z-shape bending module 200 of the servo-driven Z-shape bending device) provided by the present disclosure can also be easily integrated in an automatic connector manufacturing machine.

It could be appreciated by those skilled in the art that the embodiments described above are all exemplary and can be improved by those skilled in the art, and the structures described in the various embodiments can be freely combined unless they conflict in terms of structure or principle. Although the embodiments of the present disclosure have been described with reference to the drawings, the embodiments shown in the drawings are intended to illustrate the embodiments of the present disclosure and should not be construed as limiting the present disclosure. Although some embodiments of the present general inventive concept have been shown and described, it will be understood by those skilled in the art that changes may be made therein without departing from the principles and spirit of the present general inventive concept, the scope of the present disclosure is defined in the appended claims and their equivalents.

What is claimed is:

1. A servo-driven Z-shape bending device, comprising:

a base, the base further comprising a terminal loosening mechanism disposed on the base, the terminal loosening mechanism including a loosening jig and a loosening block, wherein the loosening jig is configured to push a portion of a terminal to be bent from a carrier to the loosening block;

a Z-shape bending module disposed on the base and configured to perform a bending operation on the terminal to be bent to form a Z-shaped terminal;

a servo-drive mechanism disposed on the base and configured to servo-drive the Z-shape bending module to perform the bending operation; and a terminal feeding mechanism disposed on the base and configured to feed the terminal to be bent to the Z-shape bending module, further comprising a Z-shape shaping sub-mechanism configured to fine tune a degree of bending of a preliminary shaped terminal and shape the preliminary shaped terminal into the Z-shaped terminal.

2. The servo-driven Z-shape bending device of claim 1, wherein the Z-shape bending module includes a first terminal bending mechanism configured to perform a first bending operation on the terminal to be bent to deform the terminal to be bent into the preliminary shaped terminal, wherein the preliminary shaped terminal is an L-shaped terminal.

3. The servo-driven Z-shape bending device of claim 2, wherein the Z-shape bending module includes a second terminal bending mechanism configured to perform a second bending operation on the L-shaped terminal to deform the L-shaped terminal into the Z-shaped terminal.

4. The servo-driven Z-shape bending device of claim 3, wherein the first terminal bending mechanism includes an L-shape bending sub-mechanism configured to bend the terminal to be bent and an L-shape shaping sub-mechanism configured to fine tune a degree of bending of the bent terminal and shape the bent terminal into the L-shaped terminal.

5. The servo-driven Z-shape bending device of claim 4, wherein the L-shape bending sub-mechanism includes:

an L-shape bending lower punch fixedly mounted to the base;

an L-shape bending upper punch mounted to the base and configured to be movable relative to the L-shape bending lower punch in a punching direction to perform a punching action on the terminal to be bent; and a first terminal pressing block mounted to the base and configured to press and fix the terminal to be bent on the L-shape bending lower punch.

6. The servo-driven Z-shape bending device of claim 5, wherein the L-shape shaping sub-mechanism includes:

a second terminal pressing block mounted to the base and configured to press and fix the bent terminal;

an L-shape shaping lower punch mounted to the base and adapted to be pressed against the bent terminal;

an L-shape shaping upper punch abutting against and fitting with the L-shape shaping lower punch; and an L-shape shaping micrometer mounted to the base and configured to act on the L-shape shaping upper punch to adjust movements of both the L-shape shaping upper punch and the L-shape shaping lower punch in a direction perpendicular to the punching direction, adjusting a degree of bending of the bent terminal to shape the bent terminal into the L-shaped terminal.

7. The servo-driven Z-shape bending device of claim 1, further comprising a Z-shape bending sub-mechanism including:

a Z-shape bending upper punch fixedly mounted to the base;

a Z-shape bending lower punch configured to be movable relative to the Z-shape bending upper punch in a punching direction to perform a punching action on an L-shaped terminal; and a third terminal pressing block mounted to the base and configured to press and fix the L-shaped terminal on the Z-shape bending upper punch.

8. The servo-driven Z-shape bending device of claim 7, wherein the Z-shape bending sub-mechanism includes:

a lower punch controlling lever mounted to the base and configured to control a movement of the Z-shape bending lower punch; and a lower punch lifting lever coupling the Z-shape bending lower punch to the lower punch controlling lever and configured to lift the Z-shape bending lower punch under the control of the lower punch controlling lever, the Z-shape bending lower punch is movable relative to the Z-shape bending upper punch in the punching direction.

9. The servo-driven Z-shape bending device of claim 8, wherein the Z-shape shaping sub-mechanism includes:

a fourth terminal pressing block mounted to the base and configured to press and fix the bent L-shaped terminal;

a Z-shape shaping lower punch mounted to the base and adapted to act directly on the bent L-shaped terminal;

a Z-shape shaping upper punch abutting against the Z-shape shaping lower punch; and a Z-shape bending micrometer mounted to the base and coupled to the Z-shape shaping upper punch.

10. The servo-driven Z-shape bending device of claim 9, wherein the Z-shape bending micrometer is configured to adjust movements of both the Z-shape shaping upper punch and the Z-shape shaping lower punch in a direction perpendicular to the punching direction, adjusting the degree of bending of the bent L-shaped terminal to shape the bent L-shaped terminal into the Z-shaped terminal.

11. The servo-driven Z-shape bending device of claim 3, wherein the servo-drive mechanism includes:

a bending servo driver mounted to the base; and a servo coupling which couples the bending servo driver to the first terminal bending mechanism and the second terminal bending mechanism.

12. The servo-driven Z-shape bending device of claim 11, wherein the bending servo driver is configured to provide the first terminal bending mechanism and the second terminal bending mechanism with a driving force through the servo coupling.

13. The servo-driven Z-shape bending device of claim 1, wherein the terminal feeding mechanism includes:

a feeding electric motor mounted to the base;

a feeding ratchet mounted to the base and configured to feed the terminal to be bent by being driven by the feeding electric motor; and a feeding sensor mounted to the base and configured to sense whether or not the terminal to be bent is located on a bending operation station.

14. The servo-driven Z-shape bending device of claim 1, further comprising a carrier guiding device disposed on the base and configured to guide a traveling direction of a carrier carrying the terminal to be bent.

15. The servo-driven Z-shape bending device of claim 1, further comprising a carrier cutting blade disposed on the base and configured to cut out a portion of a carrier carrying the Z-shaped terminal after the Z-shaped terminal is formed.

16. The servo-driven Z-shape bending device of claim 15, further comprising a vacuum adsorber disposed on the base and configured to clean the portion of the carrier carrying the Z-shaped terminal.

* * * * *